US005461215A

United States Patent [19]

Haldeman

[11] Patent Number: 5,461,215

[45] Date of Patent: Oct. 24, 1995

[54] FLUID COOLED LITZ COIL INDUCTIVE HEATER AND CONNECTOR THEREFOR

[75] Inventor: Charles W. Haldeman, Concord, Mass.

[73] Assignee: Massachusetts Institute of Technology, Cambridge, Mass.

[21] Appl. No.: 210,047

[22] Filed: Mar. 17, 1994

[51] Int. Cl.[6] ..... H05B 6/42; H01B 7/34

[52] U.S. Cl. ..... 219/677; 219/670; 219/674; 174/15.6; 336/57; 439/196; 439/485

[58] Field of Search ..... 219/677, 672, 219/674, 673, 632, 670; 174/15.6, 90; 336/60, 57; 439/190, 196, 485, 486

[56] References Cited

U.S. PATENT DOCUMENTS

| | | | |
|---|---|---|---|
| 2,457,843 | 1/1949 | Strickland, Jr. | 174/15.6 |
| 2,483,301 | 9/1949 | Roberds | 174/15.6 |
| 2,817,066 | 12/1957 | Scarpa | 336/84 |
| 2,988,804 | 6/1961 | Tibbetts | 29/155.57 |
| 3,022,368 | 2/1962 | Miller | 174/15 |
| 3,492,453 | 1/1970 | Hurst | 219/677 |
| 3,535,597 | 10/1970 | Kendrick | 317/155.5 |
| 3,764,725 | 10/1973 | Kafka | 174/15.6 |
| 3,946,349 | 3/1976 | Haldeman, III | 336/62 |
| 4,317,979 | 3/1982 | Frank et al. | 219/10.77 |
| 4,339,645 | 7/1982 | Miller | 219/10.49 R |
| 4,355,222 | 10/1982 | Geithman et al. | 219/10.57 |
| 4,392,040 | 7/1983 | Rand et al. | 219/677 |
| 4,527,032 | 7/1985 | Young et al. | 219/10.61 R |
| 4,527,550 | 7/1985 | Ruggera et al. | 128/1.5 |
| 4,549,056 | 10/1985 | Okatsuka et al. | 219/675 |
| 4,578,552 | 3/1986 | Mortimer | 219/10.41 |
| 4,761,528 | 8/1988 | Caillaut et al. | 219/10.491 |
| 4,794,220 | 12/1988 | Sekiya | 219/10.491 |
| 4,900,885 | 2/1990 | Inumada | 219/10.55 B |
| 4,942,279 | 7/1990 | Ikeda | 219/10.75 |
| 4,963,694 | 10/1990 | Alexion et al. | 174/15.6 |
| 4,975,672 | 12/1990 | McLyman | 336/198 |
| 5,004,865 | 4/1991 | Krupnicki | 174/15.6 |
| 5,101,086 | 3/1992 | Dion et al. | 219/10.491 |
| 5,313,037 | 5/1994 | Hansen et al. | 219/632 |
| 45,113,049 | 5/1992 | Border et al. | 219/10.79 |

FOREIGN PATENT DOCUMENTS

| | | | |
|---|---|---|---|
| 762111 | 6/1967 | Canada | 337/3 |

*Primary Examiner*—Philip H. Leung

*Attorney, Agent, or Firm*—Hamilton, Brook, Smith & Reynolds

[57] ABSTRACT

A fluid cooled RF transmission cable, transformer primary or secondary winding, and induction heating coil incorporating litz cable is disclosed. The heating coil comprises: a litz cable including a bundle of mutually electrically insulated, intermixed wire filaments, and a coolant tube, surrounding the litz wire, for conveying a fluid for removing heat generated by the litz cable. Also a combined coolant and electrical connector for providing an electrical connection and coolant to an inductive heating coil including a coolant tube and a litz cable housed inside the coolant tube is described. The connector comprises a tubular conductive member having an inner bore extending through the member, a distal end of the member sealably joining a terminal end of the coolant tube, to place the inner bore in communication with inside of the coolant tube, the litz cable extending into the inner bore and terminating in a low resistance electrical connection to the member, a proximal end of the member adapted for connection to one of a coolant source and a coolant intake.

16 Claims, 6 Drawing Sheets

FLUID COOLED LITZ COIL INDUCTIVE HEATER AND CONNECTOR THEREFOR

This invention was made with government support under Contract Number F19628-90-C-0002 awarded by the United States Air Force. The government has certain rights in the invention.

BACKGROUND OF THE INVENTION

Radio frequency (RF) induction heating is ideally suited for material-processing technology and has been used for many years for melting, brazing, heat treating and crystal growth. In semiconductor processing, the main reason to prefer induction heating is cleanliness. Only the susceptor and wafer are subjected to high temperatures and the heating coil can be located outside the physical enclosure. Materials at very high temperature, which cannot be contained within a crucible, can be heated directly in an RF float-zone configuration or by levitation melting. The steel industry, for example, employs RF induction for annealing cylindrical billets prior to hot working because the process is the most efficient and the least contaminating.

Many frequencies have been used for induction heating from 60 Hertz line power up to several megahertz. In general, the lower frequencies are used with large size ferrous metal work and the higher frequencies with smaller loads of low and high resistivity, which are difficult to heat.

SUMMARY OF THE INVENTION

The present invention is directed to an RF transmission cable, transformer primary or secondary winding with specific application to an induction heating coil for generating a time varying magnetic field to induce electric current formation in an electrically conducting workpiece. The coil comprises: a litz cable comprising a bundle of mutually electrically insulated, intermixed wire filaments, and a coolant tube, surrounding the litz wire, for conveying a fluid for removing heat generated by the litz cable.

The present invention is also directed to a combined coolant and electrical connector for providing an electrical connection and coolant to an inductive heating coil including a coolant tube and a litz cable housed inside the coolant tube. The connector comprises a tubular conductive member having an inner bore extending through the member, a distal end of the member sealably joining a terminal end of the coolant tube, to place the inner bore in communication with inside of the coolant tube, the litz cable extending into the inner bore and terminating in a low resistance electrical connection to the member, a proximal end of the member adapted for connection to one of a coolant source and a coolant intake.

The present invention is also directed to a transformer comprising two magnetically coupled coils and also an extension cord which is essentially a straightened out version of the coil.

The above and other features of the invention including various novel details of construction and combinations of part will now be more particularly described with reference to the accompanying drawings and pointed out in the claims. It will be understood that the particular induction heating coil embodying the invention is shown by way of illustration and not as a limitation of the invention. The principles and features of this invention may be employed and varied in numerous embodiments without departing from its scope.

DETAIL DESCRIPTION OF THE INVENTION

The induction coils that heat a given load have invariably been made with copper tubing. These coils are inexpensive, easily fabricated, and well cooled by internal water flow. Unfortunately, the power efficiency of this design is limited by the resistivity of the work coil.

Figure 1:
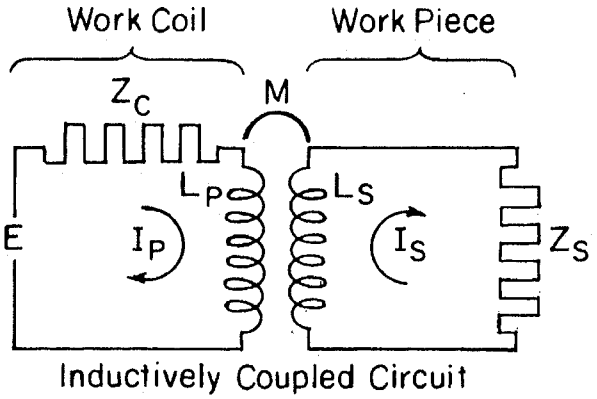
FIG. 1 is an electrical diagram of an induction heating setup.
Figure 2:
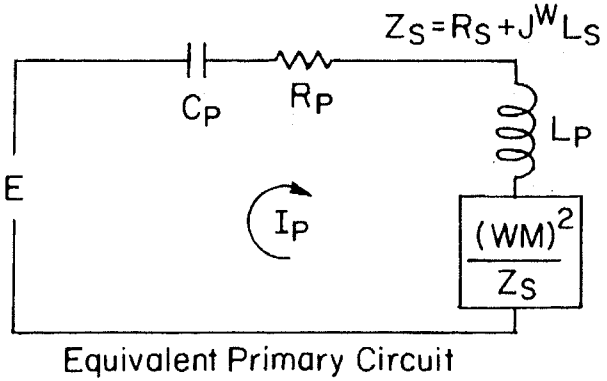
FIG. 2 is its equivalent circuit referred to the coil primary.

FIG. 1 shows the inductively coupled heating circuit consisting of source E, generalized impedance Zc and coil inductance Lp. This is coupled by mutual inductance to the work piece with inductance Ls and impedance Zs. This is usually an inductance and resistance. This can be reduced to the equivalent circuit shown in FIG. 2.

Figure 3:
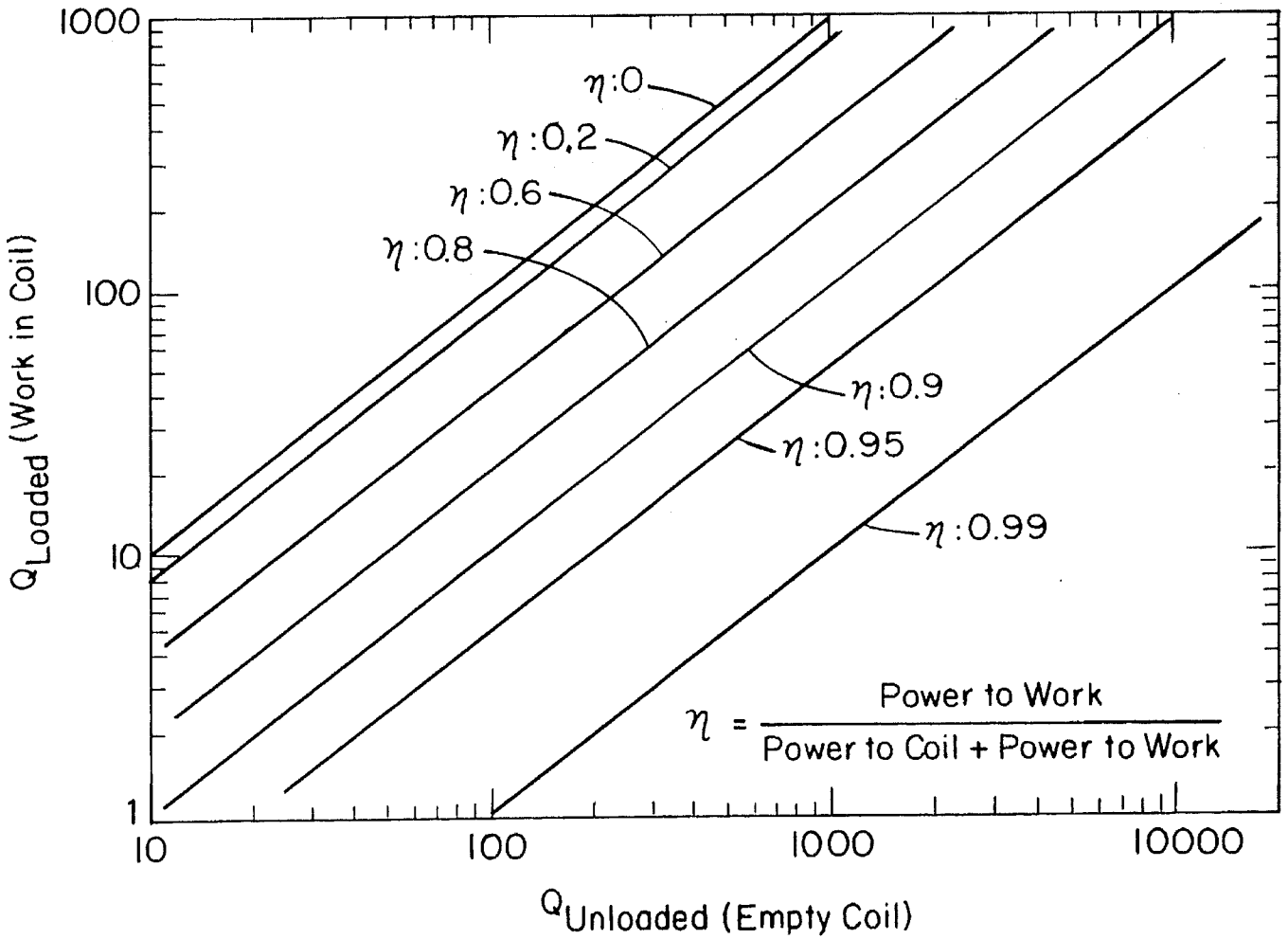
FIG. 3 is a plot of loaded vs. unloaded Q for an induction coil with heating efficiency as a parameter.

The power supply responds to the total impedance of the equivalent circuit which is a combination of resistance, capacitance, and inductance. Maximum power transfer to the load occurs when the impedance of the output circuit inducing the reactance of the loaded coil matches the impedance of the source. Maximum efficiency occurs when the resistive part of the coupled impedance is a maximum compared to the primary resistive part. RF output circuits have variable tuning impedances, usually capacitors, that can be adjusted so the capacitive reactance, $-1/j\omega C$, balances the coil inductance $j\omega L$, leaving only the resistive component of the coil and the coupled resistance of the load. Adding more turns to the coil will increase the inductance, which, to some extent, can be matched with the output circuit, but the increased coil length adds to the total resistivity of the circuit. It is clear that maximum power transfer will occur with a purely inductive work coil with low resistance. Optimum power transfer can only be achieved by matching reactances while simultaneously minimizing the resistance in all the circuit elements. This means that the $Q=\omega L/R$ of the work coil itself should be as high as possible. In fact, the heating efficiency of the circuit, the fraction of the power leaving the source that is actually delivered to the work, depends on the loaded and unloaded Q of the coil. A plot that clearly shows the effectiveness of high unloaded Q is shown in FIG. 3.

At frequencies of interest it is advantageous to use a conductor of many strands of fine, individually insulated conductor called litzendraht or simply litz. This is effective because at high frequencies, the current carried by a conductor is not uniformly distributed over the cross section as is the case with direct current. This phenomenon, referred to as the "skin effect", is a result of magnetic flux lines that circle part, but not all, of the conductor. When adjacent conductors carry additional current this tendency is increased further producing the "proximity effect". Those parts of the conductor which are circled by the greater number of flux lines will have higher inductance and hence greater reactance. The result is redistribution of current over the cross section in such a way as to cause the portion of the conductor with the highest reactance to carry the least current. With a round wire this causes the current density to be maximum at the surface and least at the center. With a square bar the current density is greatest at the corners; with a flat sheet it is greatest at the edges. In every case the alternating current is so distributed as to cause those parts of the cross section enclosed by the greatest number of flux lines to carry the least current. For copper at 20° C., the skin depth=$6.62/f^{1/2}$cm. At f=100kHz this is 0.21 mm.

The resistance of a conductor can be made to approach the DC value in this frequency regime by the use of a conductor consisting of a large number of strands of fine wire that are insulated from each other except at the ends where the various wires are connected in parallel. Formulas for computing the resistance of litz wire coils are given by F. E. Terman, *Radio Engineer's Handbook* (McGraw-Hill, New York, Sept. 1963) pp. 77–83. These have been compiled into a personal computer program by Charles W. Haldeman, E. I. Lee and A. D. Weinberg, "Litz Coil, A Convenient Design Package for Low Loss RF Coils", MIT Technology Licensing Office, Software Distribution Center, Case No. 5964LS. This program is convenient for interactive design calculations.

In order to obtain minimum effective resistance, the individual strands must be woven in such a way that each strand occupies all possible radial positions to the same extent. This is achieved by a low twist "rope lay" so that the current divides equally between strands. Coils made from litz wire have been used for many years in radio applications but connections have been difficult to make particularly in the presence of the water cooling needed for the RF induction heating applications. U.S. Pat. 3,946,349 describes a high power coil housing a cooling tube inside a rigid litz cable in which the cable's filaments are set in a rigid plastic resin matrix. The '349 patent teaches a method for removing that tube to obtain enhanced cooling for the cable.

Despite the long term existence of litz cable and its use in air cooled radio transmitters and conduction cooled small devices, it has not been adapted for induction heating because it could not be cooled effectively and operated at the high power levels needed.

The present invention represents an improvement over the method of the '349 patent since the need to remove the plastic tube from an encapsulated cable is avoided and the resulting coil is flexible enough to permit its use for different induction heating applications by merely re-orienting the turns without completely re-constructing the coil for each new work piece. The step of plastic encapsulation is also not necessary. Further, the cooling effect of the coolant is enhanced since it can penetrate the filaments of the cable.

Figure 7:
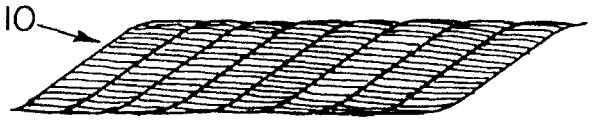
FIG. 7 is a side view of the litz cable.
Figure 6:
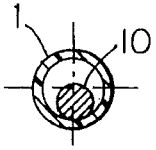
FIG. 6 is a cross-sectional view of the Teflon tube and litz cable.
Figure 4:
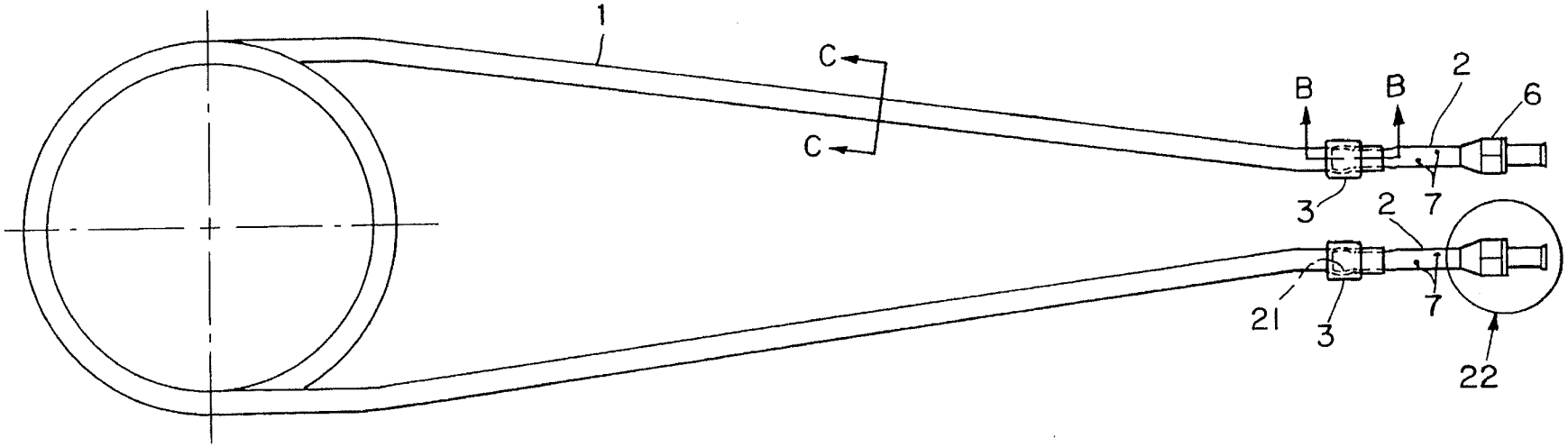
FIG. 4 is a top view of the inventive induction heating coil.
Figure 5:
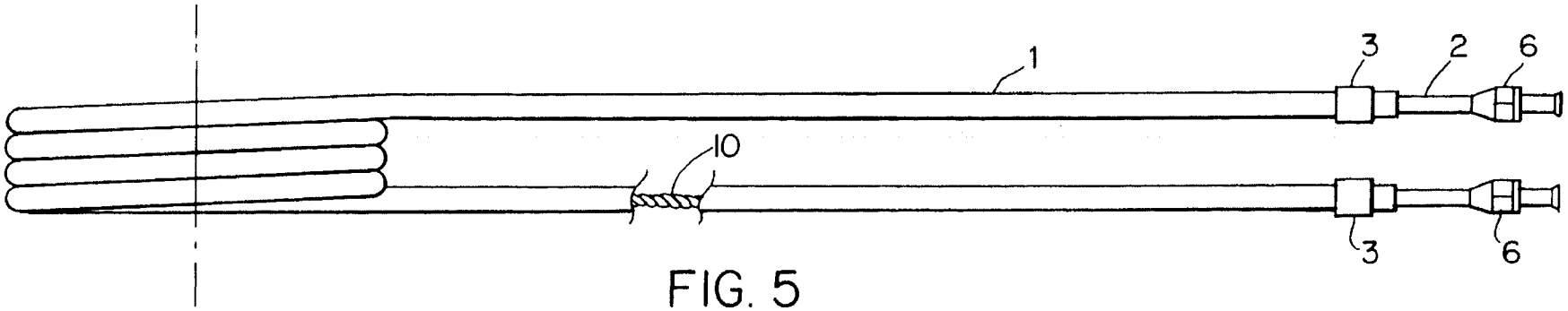
FIG. 5 is a side and partial cut-away view of the induction heating coil.

An induction heating coil constructed according to the principles of the present invention is illustrated in FIGS. 4 and 5 in which a hollow plastic or elastomeric insulating and cooling tube 1 houses a litz cable conductor 10 as shown in FIGS. 5 and 6. The tube 1 in the present embodiment is made of 0.060 inch wall Teflon (PTFE) tubing furnished by Zeus Plastics Co. The tube is outside diameter (OD) is 0.560 inch. The litz cable 10, shown in FIG. 7, is manufactured by New England Electric Wire Co., and is comprised of 21,875 strand #48 single soldereze insulated magnet wire having 5 bundles in the final lay with a pitch of 1.5 inches and an OD of 0.290 inch. The coil is cooled by de-ionized water from a Lepel induction heater. The water is pumped through the annular space between the litz cable 10 and the plastic tube 1 best shown in FIG. 6. Alternatively, the litz cable 10 could also be cooled by liquid nitrogen, Freon (Dupont), Fluoroinert (3M Co.), and Silicone 200 (Dow Corning).

The litz cable 10 comprises a large number of small diameter, individually insulated, wire filaments formed into a cable in such a manner that they are "mixed" with respect to location relative to the cable centerline. This is achieved with either braids about a hollow core or rope lay cables with and without a tubular core.

The best construction appears to be a rope lay of five individually twisted cables loosely spiraled at one turn in 2.5 cm (1 in.) to one turn in 5 cm (2.0 in.) as shown in FIG. 7. The individual cables are as loosely twisted as can be done conveniently on the machines, with each successive operation using a reverse twist. No internal intermediate servings should be used on the separate substrands. This construction provides the most uniform distribution of wires over the cross section while minimizing the additional wire length required to allow twisting.

Terminal connections to the coil are of paramount importance because they represent a high resistance point where the very large surface area of the litz cable 10 is reduced down where it is attached to the standard ½ inch copper tubing fittings used to connect to the prior art copper tubing coil.

Figure 8:
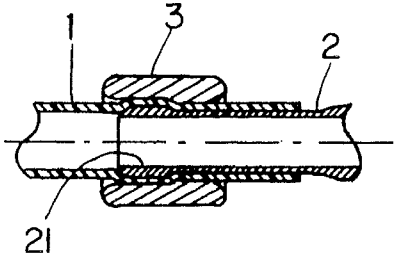
FIG. 8 is a cross-sectional view of the enlarged end of the adapter.

The terminal connections are provided by the end adapter 2 which is formed with an enlarged end 21 as shown in FIGS. 4 and 8. This enlarged end 21 is pressed into the Teflon tube 1 and retained by ferrule 3, which is pressed back over the end of the tube 1 reducing its diameter so the tube cannot slip back over the enlarged end 21 with the ferrule 3 in place.

Figure 9:
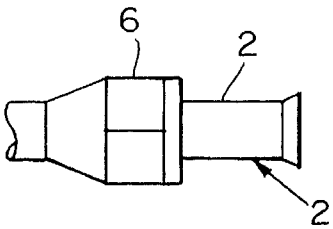
FIG. 9 is a more detailed view of the distal end of the adapter.

A distal end 22 of the adapter 2 is flared to accept a conventional flare nut 6 as best shown in FIG. 9. The flare nut 6 attaches the adapter 2 to a coolant source or intake which also carries the voltage to drive the coil. Electrical attachment of the litz cable 10 to adapter 1 is made by fishing the 5 bundles of the litz cable 10 out through the five holes 7 of the adapter 2 and soldering them firmly to the outside of the adapter's sidewall. Excess solder is used to completely fill the holes 7 and provide a water tight seal. The soldering operation is normally done before installation of the adapter 2 into the tube 1.

Note that the adapter 2 must be made with sufficient inside diameter to provide adequate flow of coolant around the cable 10.

Figure 10:
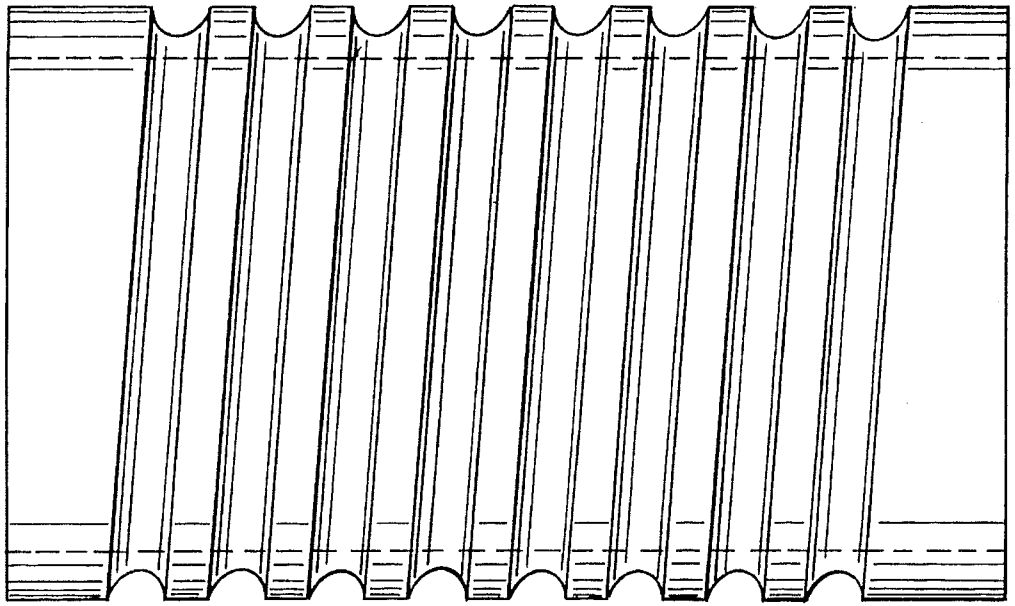
FIG. 10 is a side view of a forming arbor for coiling the induction heating coil.

The cable 10 is inserted in the tube 1 in a straight or slightly curved condition by pulling it through with a string, which has previously been inserted by blowing it through with compressed air. Both ends are then attached and the tube is pressurized to 250 psig to prevent collapse when it is wound on a forming arbor shown in FIG. 10. This provides a nominal turn radius which can be deformed elastically to provide a long stretched out solenoid or a short multi-turn coil.

Note that for good coil performance the end terminals must be removed 1 or 2 coil diameters from the coil winding by short pigtails of the tube and conductor in order to lower the field in this high resistance area.

Such coils can be used with water cooling or dielectric fluid cooling. Operation will be permissible at highest power when the boiling point of the coolant is low enough for percolative phase change cooling to take place in the cable bundle. That is, the usable temperature of the cable insulation should be higher than the boiling point, and the cooling liquid in the tube should be subcooled.

The coil can also be used with cryogenic fluids if the ferrule is made with a spring loading device to maintain positive closure of the tubing under thermal expansion conditions. The ferrule 3 should be made of non-conducting non-magnetic material such as G-10 fiberglass laminate or MACOR (Corning Glass Co.) machinable ceramic.

The combined surface area of the twelve thousand #48 wires with 0.03 mm (0.0012 in.) diameter is equivalent to a copper tube with a 36.6 cm (14.4 in.) diameter. This is seven times less resistive than a standard copper tubing coil used in current epitaxial applications, yet it occupies only the same 6.4 mm (0.25 in.) diameter. Such a coil will therefore require much lower power to achieve the same inductive currents to heat a given load. The resulting lower voltage operation is especially attractive to epitaxial reactors operating around 100 Torr, because this is a pressure regime that is likely to promote arcing in the reaction zone.

Figure 11:
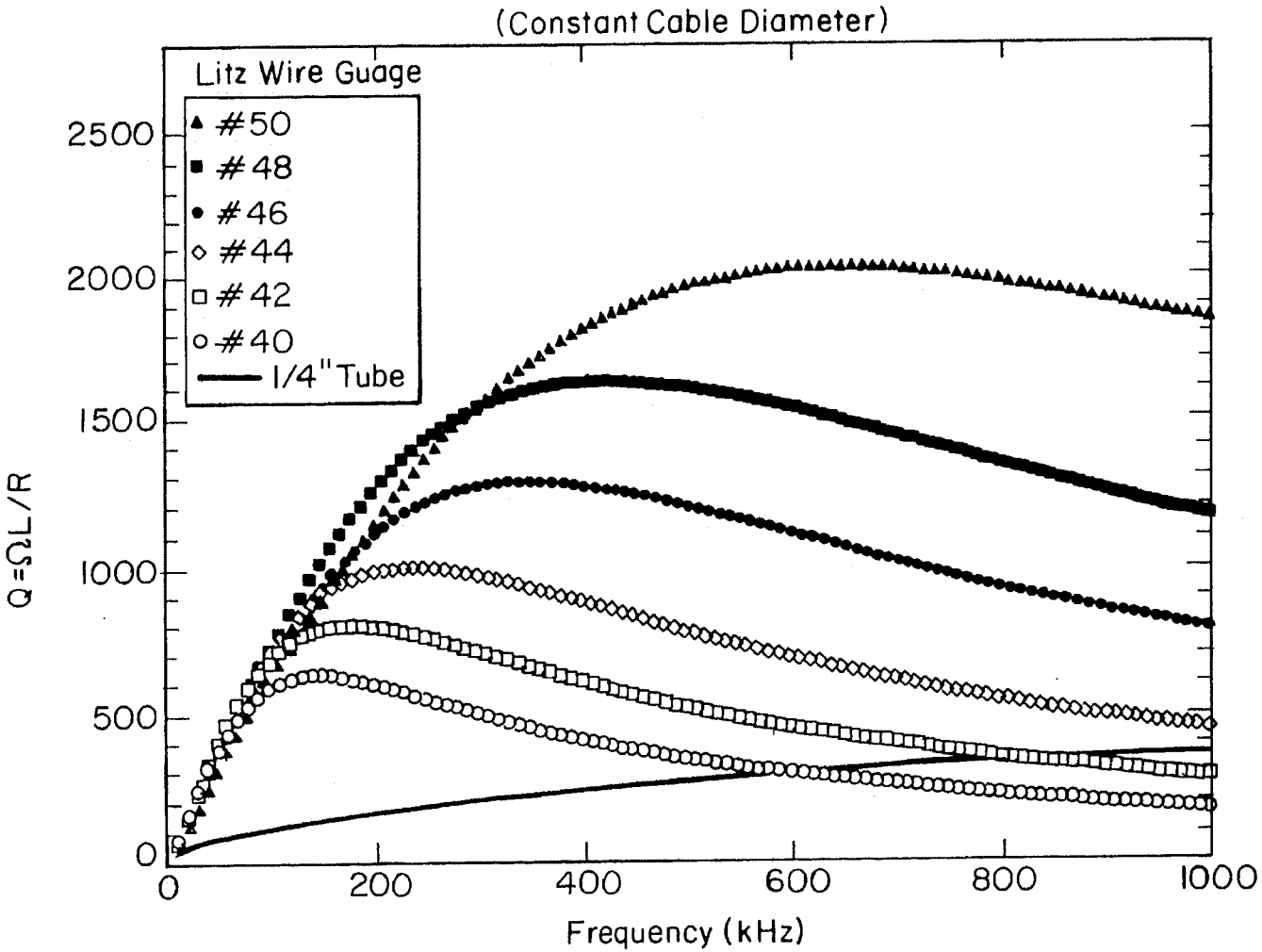
FIG. 11 is a plot of quality Q versus frequency for litz cables having different gage filaments but the same overall diameter.

FIG. 11 shows the effect of filament gage on quality as a function of frequency for a specific coil design. This design has seven turns of average diameter 16.5 cm (6.5 in.) with an average thickness of 1.9 cm (0.75 in.) and a length of 3.8 cm (1.5 in.). The conductor was composed of 12000/48 litz cable, 0.64 cm (0.20 in.) in diameter inside a 0.95 cm (0.375 in.) OD Teflon sleeve. Cooling water was passed through the annular space between the cable and tube. The inductance was 10.0 microhenry. The effect of keeping cable size and geometry constant and changing only the wire gage can be seen from the curves. For comparison, an equivalent conventional copper tubing coil is shown. An optimum coil has about ten percent of the resistance of the copper coil.

For cases where a more thermally resistant coil is needed, for example where radiative heating would damage the Teflon, a ceramic fiber braid can be slipped over the Teflon tube. 3M Co. Nextel material has been found suitable for this application. Also a rigid quartz tube helix can be used for the coolant tube provided the ends away from the heat are supplied with short lengths Teflon tubing attached by the method shown to both Quartz and copper tubing. Pulling the cable is, however, more difficult with the rigid tube.

Two coil-cable embodiments have been used to date. They are described in the table below. Since they have not been tested to failure the powers listed do not represent absolute limits but are representative operating conditions with water cooling at about 100 psi. These are being operated at from 30 to 50 times the current density currently used for air cooled litz cable coils.

TABLE I

Coil Conductor Embodiments at 300 kHz

| Conductor | Diameter | Area Circ Mlls | Tube OD | Tube ID | RMS Current | Miliamperes per Circular Mil | Current Density |
|---|---|---|---|---|---|---|---|
| 10,000 #48 | .190 in. | 15,400 | .375 | .250 | 700 amps | 45.5 | |
| 21,875 #48 | .290 | 33,667 | .560 | .435 | 1000 amps | 29.7 | |

Figure 12:
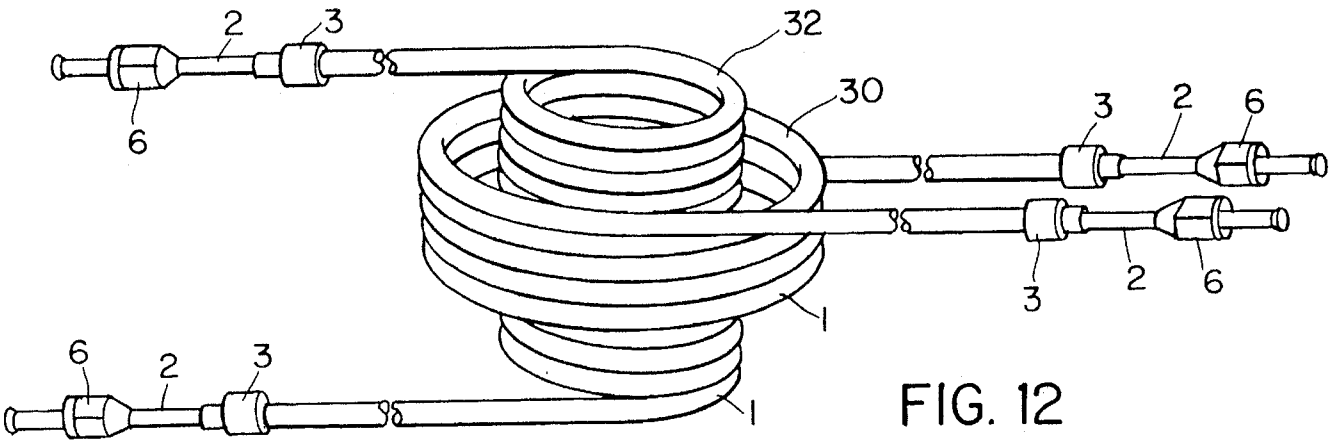
FIG. 12 is a perspective view of the inventive transformer.

Additionally, the present invention can also be adapted to transformers as illustrated in FIG. 12. an air core transformer has a primary winding 30 surrounding a secondary winding 32. Each of these windings is constructed as the inductive heating coil of FIGS. 4 through 9. No solid core is provided since in most applications, it would limit the transformers overall Q because of eddy current losses.

Figure 13:
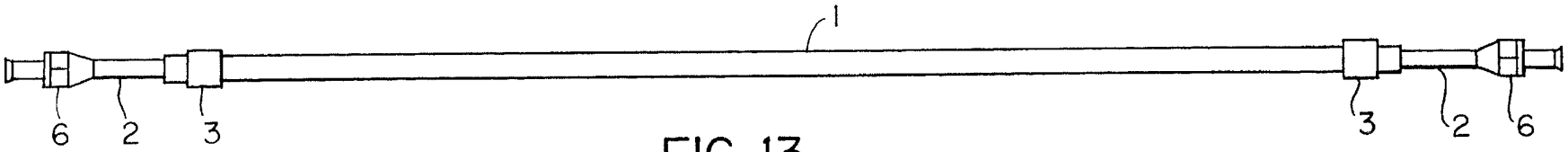
FIG. 13 is a side view of the inventive extension cord.

Finally, FIG. 13 shows litz conductor extension cord for providing coolant and electrical connectors between an inductive heating coil and an RF generator. The overall configuration of this extension cord is that of the inductive heating coil but straightened out.

Those skilled in the art will know or be able to ascertain using no more than routine experimentation, many equivalents to the specific embodiments of the invention described herein.

These and all other equivalents are intended to be encompassed by the following claims.

We claim:

1. An induction coil for generating a time varying magnetic field to induce electric current formation in an electrically conducting substance, the coil comprising:

a litz cable comprising a bundle of mutually electrically insulated wire filaments;

a coolant tube, surrounding the litz cable and extending substantially parallel with the litz cable, for conveying a fluid for removing heat generated by the litz cable; and at least one connector including:

a tubular conductive member sealably joining the coolant tube, the tubular member having an axial bore in fluid communication with the coolant tube and having at least one radial hole extending through a side wall of the tubular member into the axial bore, the litz cable extending into the bore, through the radial hole, and electrically connecting to the tubular member.

2. An induction coil as claimed in claim 1, wherein the insulated wire filaments are loosely bound in the coolant tube.

3. An induction coil as claimed in claim 1, wherein the coolant tube is constructed of a flexible resin.

4. An induction coil as claimed in claim 1, wherein the wire filaments are not mechanically bound to each other in a resin matrix.

5. An induction coil as claimed in claim 1, wherein the tubular conductive member is adapted to be connected to an electrical fitting supplying the fluid.

6. An induction coil as claimed in claim 5, wherein the litz cable is divided into plural bundles of the wire filaments and the bundles are separately drawn through different ones of plural radial holes.

7. An induction coil as claimed in claim 6, wherein the bundles are electrically connected to an outer surface of the tubular conductive member.

8. An induction coil as claimed in claim 7, wherein the bundles as soldered to the outer surface.

9. An induction coil as claimed in claim 8, wherein the solder is used to seal the radial holes.

10. An induction coil as claimed in claim 5, further comprising a flare nut fitting over a terminal end of the tubular conductive member to sealably join the tubular conductive member to the electrical fitting.

11. An induction as in claim 1, wherein the coolant tube is Quartz glass.

12. An induction coil as in claim 1, wherein the coolant tube includes an external braid of ceramic fiber.

13. An induction coil as in claim 1, wherein the coolant tube extends over an enlarged end of the tubular member and is held in place by a ferrule.

14. An induction coil as in claim 1, further comprising:

a second litz cable magnetically coupled to the first litz cable and comprising a bundle of mutually electrically insulated wire filaments; and a second coolant tube surrounding the second litz cable for conveying a fluid for removing heat generated by the second litz cable.

15. An induction coil as claimed in claim 14, wherein the insulated wire filaments are loosely bound in the first litz cable and the second litz cable.

16. A combined coolant and electrical connector for providing an electrical connection and coolant to an inductive heating coil including a coolant tube and a conductive multi-filament litz cable housed inside of the coolant tube, the connector comprising a tubular conductive member having an inner bore extending through the member and having plural axial holes extending through a side wall of the member, a distal end of the member sealably joining a terminal end of the coolant tube to place the inner bore in communication with an inside of the coolant tube, the multi-filament litz cable extending into the inner bore, and separate bundles of the filaments extending through the plural axial holes and terminating in a low resistance electrical connection to the member, a distal end of the member adapted for connection to one of the coolant source and a coolant intake.

* * * * *

UNITED STATES PATENT AND TRADEMARK OFFICE

CERTIFICATE OF CORRECTION

PATENT NO. : 5,461,215
DATED : Oct. 24, 1995
INVENTOR(S) : Charles W. Haldeman

It is certified that error appears in the above-indentified patent and that said Letters Patent is hereby corrected as shown below:

Col. 7, line 6, after "induction" insert --coil--.

Signed and Sealed this

Sixth Day of February, 1996

*Attest:*

Bruce Lehman

BRUCE LEHMAN

*Attesting Officer*

*Commissioner of Patents and Trademarks*